United States Patent [19]

Cappel et al.

[11] 4,050,924

[45] Sept. 27, 1977

[54] PROCESS OF CONTROLLING FE++ CONTENT OF SINTERED IRON ORE

[75] Inventors: Fred Cappel, Sprendlingen; Walter Hastik, Frankfurt am Main, both of Germany; Georg Fleming; Pierre Hofmann, both of Esch, Alzette, Luxembourg

[73] Assignee: Dravo Corporation, Pittsburgh, Pa.

[21] Appl. No.: 637,395

[22] Filed: Dec. 3, 1975

[30] Foreign Application Priority Data

June 3, 1975 Germany ..... 2524444

[51] Int. Cl.[2] ..... C22B 1/16

[52] U.S. Cl. ..... 75/5; 75/3

[58] Field of Search ..... 75/3, 4, 5, 7; 264/117

[56] References Cited

U.S. PATENT DOCUMENTS

| | | | |
|---|---|---|---|
| 2,965,265 | 12/1960 | Schuerger et al. | 75/5 |
| 3,153,587 | 10/1964 | Schuerger | 75/5 |
| 3,330,644 | 7/1967 | Haussig | 75/5 |
| 3,642,465 | 2/1972 | Sie | 75/4 |
| 3,647,417 | 3/1972 | Wetzel et al. | 75/5 |

FOREIGN PATENT DOCUMENTS

| | | | |
|---|---|---|---|
| 1,169,472 | 3/1964 | Germany | 75/5 |

OTHER PUBLICATIONS

Herman, A., et al.; Metallurgical Reports CNRM, Nov. 16, 1968, pp. 11–18.

Cappel, F.; Stah and Eisen, vol. 84, pp. 1304–1313, TS300S-7, (1964).

*Primary Examiner*—L. Dewayne Rutledge

*Assistant Examiner*—Michael L. Lewis

*Attorney, Agent, or Firm*—Parmelee, Miller, Welsh & Kratz

[57] ABSTRACT

A process for controlling the quality of sintered iron ore in which the Fe+ content of the sintered or is regulated by controlling the recycled-fines feed rate. The recycled-fines feed rate, determined by a prior art recycled-fines balance controller, is modified by a desired fines withdrawal rate generated in an Fe+ content controller as the difference between the actual Fe+ content of the sintered ore and a desired content. In a preferred form, the difference between the recycled-fines feed rate and the desired fines withdrawal rate is also applied to the Fe+ content controller.

5 Claims, 2 Drawing Figures

PROCESS OF CONTROLLING FE++ CONTENT OF SINTERED IRON ORE

BACKGROUND OF THE INVENTION

1. Field of the Invention

This invention relates to a process of controlling the quality of sintered iron ore which has been produced in belt-type sintering plants provided with recycled-fines balance controllers which match the fines withdrawal rate with the recycled-fines feed rate.

2. Prior Art

The uniform operation of a blast furnace depends on a high and constant quality of the sintered iron ore.

The most important requirements to be met by the sintered iron ore are:

1. The chemical analysis of the sintered iron ore should be such that the blast furnace slag has a predetermined basicity;

2. The physical properties of the sintered iron ore should be such as to ensure a satisfactory behavior of the sintered iron ore in transit and in the blast furnace;

3. The reducibility of the sintered iron ore should by such that coke is consumed in the blast furnace at a low rate.

The chemical analysis of the sintered iron ore is selected by a proper mixing of ores and, if desired, admixtures. Large mixing beds are often used for this purpose and will ensure a homogenization to a high degree if they are carefully composed.

The remaining requirements regarding the quality of the sintered iron ore can be met only by the selection of suitable operating conditions and by the maintenance of a uniform operation.

In numerous plants, a control of the recycled-fines balance has been adopted to promote the uniformity ("Stahl und Eisen" 84 (1964), pages 1304–13). The recycled-fines balance control provides for a fuel rate which ensures a good recycled-fines balance in conjunction with a predetermined recycled-fines feed rate. Fluctuations in the recycled-fines balance are detected as changes of the recycled-fines bin content. A proportional-plus-integral controller changes the fuel rate in response to a change of the recycled-fines bin content. Because sintering plants operate with large time constants owing to the long handling times, the control response to a change of the recycled-fines bin content is improved in that the recycled-fines feed rate is temporarily changed too. A uniform operation with a good recycled-fines balance in conjunction with a predetermined fines withdrawal rate can be maintained with this control system.

The proportion of fines in the burden of a blast furnace depends on the mechanical strength of the sintered iron ore. To ensure a satisfactory behavior of the sintered iron ore in transit, as well as a regular operation of the blast furnace and a high throughput thereof, the strength of the sintered iron ore must not fall below a lower limit. The strength of the sintered iron ore is determined by known tests (ISO drum test) from samples taken once an hour, on an average.

The $Fe^{++}$ content is also highly significant for the operation of the blast furnace because high $Fe^{++}$ values lower the reducibility of the sintered iron ore so that the coke consumption in the blast furnace is excessive. Excessively low $Fe^{++}$ contents involve a high recycled-fines feed rate so that the output of the sintering plant is decreased. Besides, the strength of the sintered iron ore is lower if the $Fe^{++}$ content is below a certain limit, e.g., 6% $Fe^{++}$. In most cases, the $Fe^{++}$ content is determined in the laboratory by X-ray fluorescence analysis of suitable pretreated samples. A measurement of the magnetic properties of the sintered iron ore has been suggested, (Metallurgical Reports CNRM, No. 16, 1968, pages 11–18) and enables a continuous measurement of the $Fe^{++}$ content in the plant. In this connection, it has been found suitable to provide for an automatic recalibration based on laboratory analyses.

Statistical investigations have shown that in case of a given mineralogical composition of the mixing bed, the strength of the sintered iron ore depends in a high degree on the height of the bed during the sintering operation. To ensure a strength above a lower limit, the height of the bed must be maintained above a minimum for a given mixture. On the other hand, it is not desirable to provide for a much higher bed for safety reasons because this would result in a loss in output. The height of the bed is substantially determined by these considerations.

SUMMARY OF THE INVENTION

It is an object of the invention to provide a control system which ensures an optimum compensation of fluctuations in the $Fe^{++}$ content and maintains in the plant a desired, adjustable $Fe^{++}$ content of the sintered iron ore (desired value) whereas there is a good recycled-fines balance.

This object is accomplished according to the invention in that the $Fe^{++}$ content of the final sintered iron ore is controlled by a known method and the desired fines withdrawal rate set at the recycled-fines balance controller is changed to correct the $Fe^{++}$ content to a desired value.

The invention is based on the surprising recognition that the recycled-fines feed rate determines the quality of the sinter, specifically its $Fe^{++}$ content, whereas the fuel rate required for sintering must be selected so that there is a good recycled-fines balance in continuous operation because the storage capacity is limited. The desired fines withdrawal rate is reduced if the measured $Fe^{++}$ content is below the desired value, and is increased if the $Fe^{++}$ content is excessive. The control action increments, starting materials, and the operating conditions of the sintering plant and time are empirically determined.

According to a preferred feature, the difference between the recycled-fines feed rate and the desired fines withdrawal rate is additionally applied to the $Fe^{++}$ content controller.

According to a further preferred feature, a deviation of the recycled-fines bin content from the desired value is applied to the $Fe^{++}$ content controller. As a result, a disturbance in the recycled-fines balance will be detected at an early time and its disturbing effect on the $Fe^{++}$ content can be opposed at an early time.

According to a further preferred feature, the strength of the sintered iron ore is also measured and the desired $Fe^{++}$ content and/or the desired fines withdrawal rate is corrected in dependence thereon. In this case, changes in the strength of the sintered iron ore which are due to a change in the composition of the ore or of the height of the bed can be detected an opposed.

According to another preferred feature, the desired fines withdrawal rate is changed by incremental control actions. In this case, the control can be performed even when results of measurements are available only periodically in larger intervals of time.

DESCRIPTION OF THE PREFERRED EMBODIMENT

Figure 1:
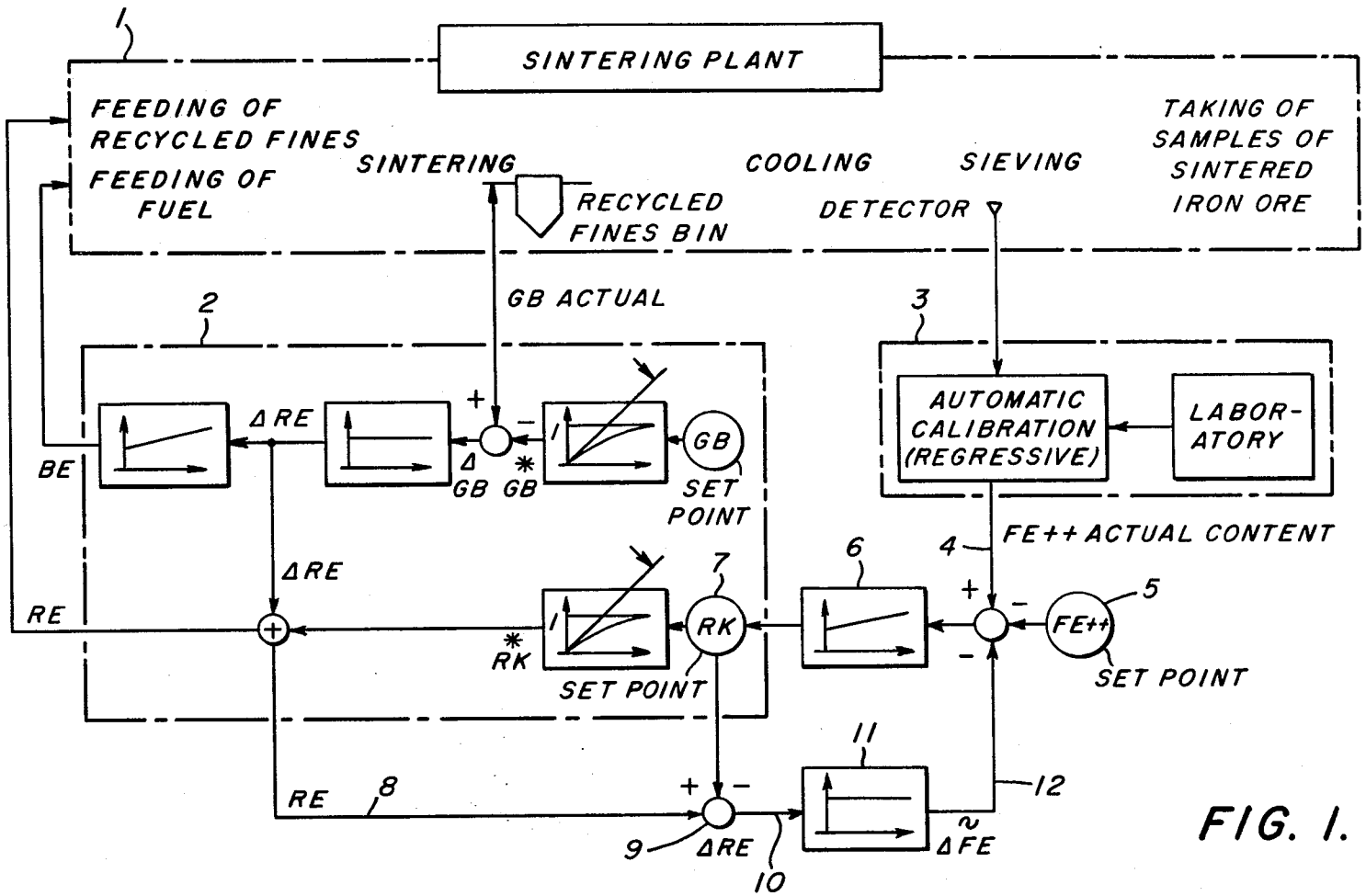
FIG. 1 is a diagrammatic representation of a sintering plant embodying the invention.

FIG. 1 illustrates a sintering plant 1 regulated by a recycled-fines balance controller 2. A measuring system 3 serves to determine the actual $Fe^{++}$ content 4. The drawing shows the continuous determination by a measurement of the magnetic properties of the sintered iron ore in conjunction with a recalibration based on laboratory analyses. Other suitable methods, such as X-ray fluorescence analysis, may be alternatively used to determine the actual $Fe^{++}$ value 4. The actual $Fe^{++}$ content 4 is compared with an adjustable, desired $Fe^{++}$ content 5. The difference is applied to the controller 6, which controller 6, which controls the desired fines withdrawal rate $R_{Ksoll}$ 7 to which the recycled-fines balance controller 2 is set. To improve the control action, the recycled-fines feed rate $R_E$ 8 is compared in a comparator with the desired fines withdrawal rate $R_{Ksoll}$ 7 and the resulting difference $\Delta R_E$ 10 is applied to a controller 11, which produces a signal $\Delta \widetilde{F}_E$ 12, which indicates how the $Fe^{++}$ content is to be changed owing to the temporary difference $\Delta R_E$ 10 between the desired fines withdrawal rate and the recycled-fines feed rate. The signal 12 is applied in a suitable manner to the $Fe^{++}$ controller 6 and causes the latter to increase or decrease the change of the desired fines withdrawal rate 7 in case of a temporary difference $\Delta R_E$ 10 between the desired fines withdrawal rate and the recycled-fines feed rate and a simultaneous deviation of the actual $Fe^{++}$ content 4 from the desired $Fe^{++}$ content 5. In this way, the change in $Fe^{++}$ content ($\Delta \widetilde{F}_E$ 12) to be expected as a result of the action of the recycled-fines balance controller can be calculated and can be taken in account in the $Fe^{++}$ content control.

Figure 2:
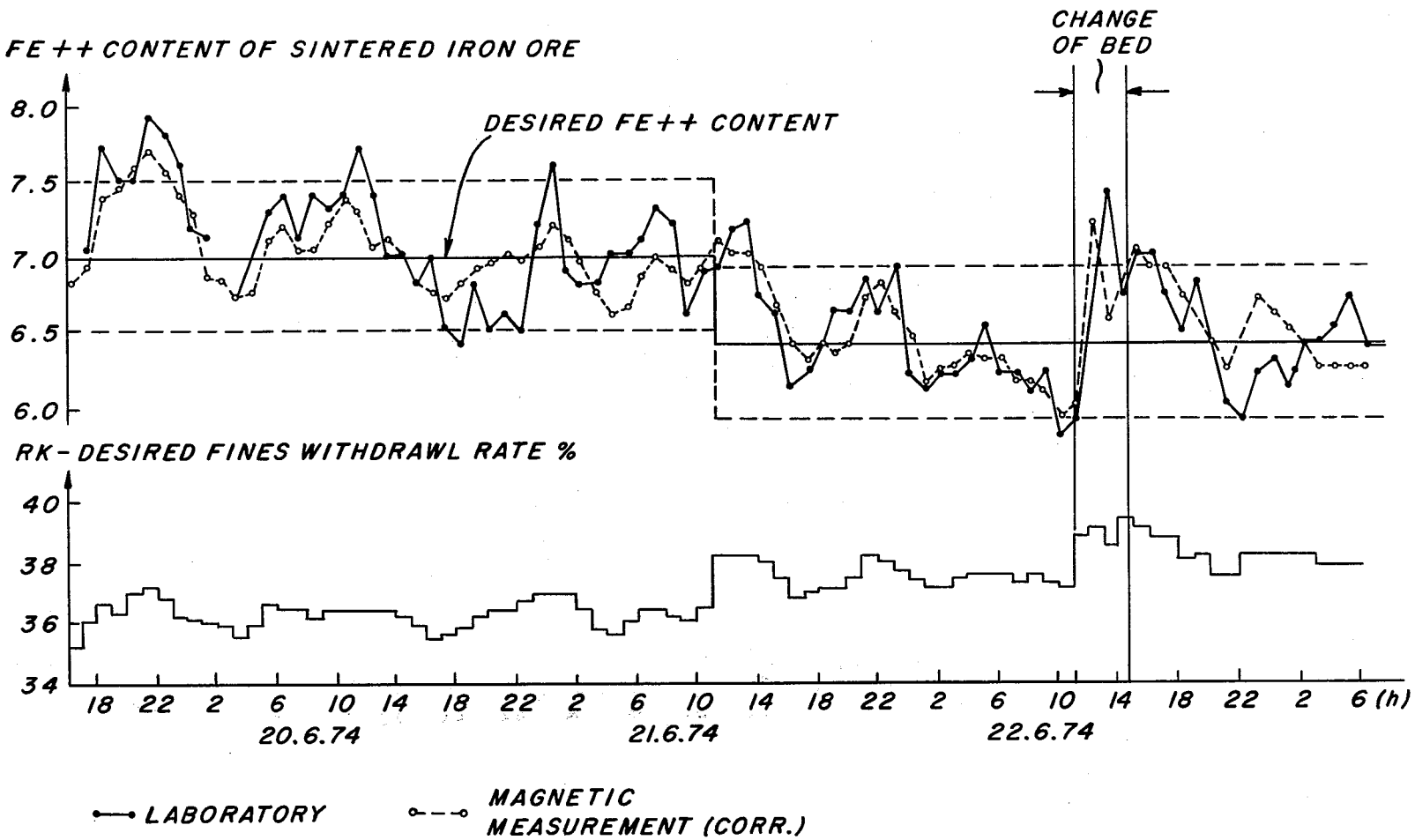
FIG. 2 is a graphic representation of the operation of the sintering plant illustrated in FIG. 1.

FIG. 2 illustrates a typical period of about 84 hours of continuous operation. June 21, 1974, at 11 hours, the desired $Fe^{++}$ content was reduced from 7.0 to 6.4 percent. It is clearly apparent that the desired fines withdrawal rate $R_K$ was changed from about 36 to about 38 percent. The transition of the $Fe^{++}$ content to the new desired value shows the good response of the system to a change of the desired value. Whereas difficulties are always involved in the change to a new mixing bed (June 22, 1974), the response to this change is also quick and reliable.

The advantages of the invention will now be set forth with reference to the results of the operation of two belt-type sintering machines, which were fed from the same mixing bed in a plant under the same conditions. One plant was provided with the control system according to the invention. In the comparison plant, the recycled-fines balance controller was manually adjusted to a desired fines withdrawal rate.

In the comparison period (May, 1974), the standard deviation $\sigma_{S1} = 0.91$ (manual control) was reduced to $\sigma_{S2} = 0.56$ (invention). This enabled the selection of a lower mean value (desired value) because the risk of a decrease below the lower limit as a result of the $Fe^{++}$ control is correspondingly decreased. Whereas the lower limit is approximately the same, the mean $Fe^{++}$ content is lower by 0.5% $Fe^{++}$ in the example shown.

A decrease in the $Fe^{++}$ content of the sintered iron ore by 0.5% means a saving of fuel amounting to $$B_S = 0.5\,(\%Fe^{++}) \times 4\left(\frac{kg}{\%Fe^{++} \times t_{sinter}}\right) = 2\,\frac{kg}{t_{sinter}}$$

in the sintering plant and $$B_M = 0.5\,(\%Fe^{++}) \times 3.5\left(\frac{Kg}{\%Fe^{++} \times t_{sinter}}\right) = 1.75\,\frac{kg}{t_{sinter}}$$

in the blast furnace (t = metric ton). The improvement of the $Fe^{++}$ content of the sintered iron ore, which was produced in both plants at a rate of 22,000 metric tons per day, resulted in a total fuel saving of about 82 metric tons per day. On the other hand, the desired $Fe^{++}$ content must not be too low because the sintered iron ore must have a strength above the lower limit discussed hereinbefore and because the output decreases in the case of very low $Fe^{++}$ contents.

We claim:

1. In a process for controlling the quality of sintered iron ore produced in a belt-type continuous sintering operation wherein a recycled-fines balance controller regulates the fuel rate and the recycled-fines feed rate to maintain a recycled-fines balance, the improvement comprising: determining the actual $Fe^{++}$ content of the sintered iron ore, selecting a preset $Fe^{++}$ content, applying the difference between the actual $Fe^{++}$ content preset $Fe^{++}$ content to an $Fe^{++}$ content controller to produce a desired fines withdrawal rate, and modifying the recycled-fines feed rate as a function of the desired fines withdrawal rate to correct the $Fe^{++}$ content to the preset value.

2. The process of claim 1 including the additional step of applying the difference between the recycled-fines feed rate and the desired fines withdrawal rate to the $Fe^{++}$ content controller to modify the desired fines withdrawal rate produced thereby.

3. The process of claim 1 wherein the recycled-fines feed rate is determined as a function of the contents of a recycled-fines bin and including the step of applying the deviation of the contents of the recycled-fines bin from a desired value to the $Fe^{++}$ content controller.

4. The process of claim 1 including the steps of measuring the strength of the sintered iron ore and adjusting the value of the preset $Fe^{++}$ content as a function thereof.

5. The process of claim 1 wherein the desired fines withdrawal rate is changed by incremental control actions.

* * * * *

UNITED STATES PATENT OFFICE

CERTIFICATE OF CORRECTION

PATENT NO. : 4,050,924

DATED : Sept. 27, 1977

INVENTOR(S) : Fred Cappel, et al.

It is certified that error appears in the above-identified patent and that said Letters Patent are hereby corrected as shown below:

In the Abstract:

In line 2, "$Fe^{+}$" should read --$Fe^{++}$-- and "or" should read --ore--.

In lines 6 and 7, "$Fe^{+}$" should read --$Fe^{++}$--.

In line 11, "$Fe^{+}$" should read --$Fe^{++}$--.

In column 1, line 23, "by" should read --be--.

In column 2, line 65, "an" should read --and--.

In column 4, second equation at line 20, "Kg" should read --kg--.

In claim 1, line 41, insert --and the-- before "preset $Fe^{++}$."

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*